US005547595A

United States Patent [19]

Hacias

[11] Patent Number: 5,547,595

[45] Date of Patent: Aug. 20, 1996

[54] AQUEOUS LUBRICANT AND PROCESS FOR COLD FORMING METAL, PARTICULARLY POINTING THICK-WALLED METAL TUBES

[75] Inventor: Kenneth J. Hacias, Sterling Heights, Mich.

[73] Assignee: Henkel Corporation, Plymouth Meeting, Pa.

[21] Appl. No.: 384,978

[22] Filed: Feb. 7, 1995

[51] Int. Cl.[6] ..... C10M 173/02

[52] U.S. Cl. ..... 508/156; 72/42; 508/158; 508/160

[58] Field of Search ..... 252/49.3, 25, 52 A

[56] References Cited

U.S. PATENT DOCUMENTS

| | | | |
|---|---|---|---|
| 3,180,843 | 4/1965 | Dickerson | 260/30.6 |
| 3,527,726 | 9/1970 | Gower et al. | 260/29.6 |
| 3,568,486 | 3/1971 | Rosenberg et al. | 72/42 |
| 3,629,112 | 12/1971 | Gower et al. | 252/49.3 |
| 3,645,897 | 2/1972 | Gower et al. | 252/34.7 |
| 3,657,123 | 4/1972 | Stram | 252/34.7 |
| 3,925,214 | 12/1975 | Livingston et al. | 252/21 |
| 4,285,223 | 8/1981 | Das et al. | 72/42 |
| 4,403,490 | 9/1983 | Sargent | 72/42 |
| 4,416,132 | 11/1983 | Sargent | 72/41 |
| 4,448,701 | 5/1984 | Duerksen et al. | 252/49.3 |
| 4,533,481 | 8/1985 | Jahnke | 252/49.3 |
| 4,606,837 | 8/1986 | McEntire et al. | 252/49.3 |
| 4,636,321 | 1/1987 | Kipp et al. | 252/49.3 |
| 4,654,155 | 3/1987 | Kipp et al. | 252/32.5 |
| 4,675,125 | 6/1987 | Sturwold | 252/118 |
| 4,731,190 | 3/1988 | O'Lenick, Jr. et al. | 252/49.3 |
| 4,931,197 | 6/1990 | Beck et al. | 252/56 R |
| 5,259,970 | 11/1993 | Kanamori et al. | 252/49.3 |
| 5,286,300 | 2/1994 | Hnatin | 252/49.3 |
| 5,368,757 | 11/1994 | King | 252/49.3 |

FOREIGN PATENT DOCUMENTS

| | | |
|---|---|---|
| 0267558 | 5/1988 | European Pat. Off. . |
| 52-065748 | 5/1977 | Japan . |
| 59-149995 | 8/1984 | Japan . |
| 60-099200 | 6/1985 | Japan . |
| 63-008489 | 1/1988 | Japan . |
| 63-301297 | 12/1988 | Japan . |
| 433201 | 12/1974 | U.S.S.R. . |

OTHER PUBLICATIONS

Bastian, *Metalworking Lubricants,* McGraw–Hill, New York, 1951, p. 65 (month n/a).

Smalheer & Smith, *Lubricant Additives,* The Lezius–Hiles Co., Cleveland, Ohio, 1967, pp. 7–8 (month n/a).

*Primary Examiner*—Ellen M. McAvoy

*Attorney, Agent, or Firm*—Ernest G. Szoke; Wayne C. Jaeschke; Norvell E. Wisdom, Jr.

[57] ABSTRACT

A lubricant composition including ethoxylated long chain primary alcohols and, preferably, boron compounds but excluding most other previously used organic lubricant materials gives superior results in tube pointing operations, especially with thick walled tubes, and is also useful for drawing operations, either subsequent to pointing or independently of pointing, where very high quality surface finishes are desired.

20 Claims, No Drawings

AQUEOUS LUBRICANT AND PROCESS FOR COLD FORMING METAL, PARTICULARLY POINTING THICK-WALLED METAL TUBES

BACKGROUND OF THE INVENTION

1. Field of the Invention

This invention relates to aqueous liquid lubricant compositions suitable for forming a coating containing an organic binder material on metal surfaces that are coated with a layer of the liquid composition and then dried without rinsing, so that the solids content of the aqueous composition forms on the metal surface a solid layer that lubricates the surface during subsequent cold working operations. The solid film thus deposited is protective against mechanical damage during cold working of the underlying metal. The metal surface processed as described above may or may not have other surface layers, such as phosphate or chromate conversion coatings, coatings formed by anodization, complex oxoide layers such as those that can be formed with a commercially available product named BONDERITE® 770X from the Parker Amchem Div. of Henkel Corp., Madison Heights, Mich., or the like, underlying the coating produced on the surface by using this invention. The invention is particularly suited to the pointing and drawing of thick walled metal tubes, particularly steel tubes.

2. Statement of Related Art

The basic conventional method for reducing the diameter and wall thickness of metal tubing by cold working is known in the art as "drawing". In drawing, a material harder and stronger than the metal being processed is used as a mandrel inside the tube, to prevent wall thickening that would otherwise occur if tubing were simply pulled, with no mechanical restraint except at its ends. When substantial reductions in outside diameter are to be achieved, it is known in the art to precede the drawing operation itself with another process called "pointing". In pointing, a hard and strong material that shapes the metal tubing being processed is used in the form of a die outside the tubing being worked, almost always completely surrounding it. Reduction of tube diameter with an increase in wall thickness normally occurs when ductile metal tubing is forced through a pointing die with an inside diameter smaller than the outside diameter of the metal tubing being processed. Thus pointing is almost always followed by drawing.

Pointing usually accomplishes a greater proportionate reduction in outside diameter than does drawing, but the total amount of metal movement and the speed, friction, and heat generated are usually greater in drawing than in pointing. Thus the two operations have different minimum requirements for lubricants: Many lubricants that are adequately protective for drawing have been found to be inadequate for pointing, and it is also possible, although less common, for lubricants suitable for pointing to be inadequate for drawing.

Many aqueous liquid compositions that form coatings on metal surfaces that protect the metal surface while it is being cold worked are known. The previously most effective ones have generally been zinc and/or sodium soaps applied over a preceding heavy phosphate conversion coating. (Normally, a sodium stearate or other sodium soap salt is applied over a zinc phosphate coating. Reaction between the sodium soap and the zinc in the zinc phosphate coating is believed to result in both zinc soap and sodium soap layers.) However, this combination is environmentally disadvantageous, because the liquid compositions used to form phosphate coatings generally contain some types of metal ions, such as those of zinc, nickel, manganese, and/or the like, that are regarded as polluting, and the phosphate ions themselves, which are required in phosphate conversion coating forming liquid compositions, are environmentally undesirable in waste waters because of their promotion of eutrophication of natural bodies of water. Zinc soaps are substantially insoluble in water, but cause workplace nuisances at best and hazards at worst because they tend to form fine dust particles in the air around sites of cold working processes when used as cold working lubricants.

DESCRIPTION OF THE INVENTION

Objects of the Invention

A major object of this invention is to provide lubricants and processes that will eliminate or at least reduce the environmental disutilities noted above while still achieving cold working performance that is adequate when compared with the prior art use of phosphate conversion coatings followed by zinc soap application. Another object is to reduce total energy and/or other costs of cold forming operations, particularly by reducing process related waste of objects being cold worked and/or by achieving higher production rates per unit time. Still another object is to provide a lubricant satisfactory for both pointing and drawing under the more severe conditions in current commercial practice.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts" of, and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

SUMMARY OF THE INVENTION

It has been found that a lubricant composition consisting essentially or, or preferably consisting of, a combination of:

(A) ethoxylated straight chain aliphatic alcohol molecules, wherein the initial alcohol molecules have a single —OH moiety and at least 18 carbon atoms; and, optionally but preferably, (B) a component of inorganic boron containing acids or salts thereof, and not containing more than small amounts of any of the following: copolymers of styrene and maleic moieties; at least partially neutralized copolymers of (i) an alkene that contains no carboxyl or carboxylate group and (ii) a comonomer that is an organic acid including the moiety C=C—COOH, such at least partially neutralized polymers of organic acids often being denoted in the art generally and hereinbelow as "ionomers"; oxidized polyethylene; urethane polymers and copolymers; surfactants that are not part of component (A) and are not corrosion inhibitors; polyoxyalkylene polymers not containing an end group having at least 17 carbon atoms in a chain without any intervening carbon-oxygen bonds; and alkoxylates of Guerbet alcohols are exceptionally good lubricants for tube pointing and/or drawing operations, particularly for thick walled tubes. Thick walled tubes are defined herein as tubes meeting at least one of the following criteria: (i) the ratio of the outside diameter to the wall thickness expressed in the same units is <10; and/or (ii) the wall thickness is ≧6.3 5 millimeters (hereinafter usually abbreviated "mm").

Embodiments of the invention include working aqueous liquid compositions suitable for contacting directly with metal surfaces to provide protective coatings thereon after drying; liquid or solid concentrates that will form such working aqueous liquid compositions upon dilution with water only; processes of using working aqueous liquid compositions according to the invention as defined above to form protective coatings on metal surfaces and, optionally, to further process the metal objects with surfaces so protected; protective solid coatings on metal surfaces formed in such a process, and metal articles bearing such a protective coating. In addition to the essential ingredients noted above, aqueous compositions according to the invention will of course contain water and may optionally also contain one or more corrosion inhibitors. Usually the presence of such corrosion inhibitors is preferred.

DESCRIPTION OF PREFERRED EMBODIMENTS

In a working aqueous composition according to the invention, the concentration of component (A) preferably is, with increasing preference in the order given, at least 0.2, 0.8, 1.6, 2.4, 3.2, 4.0, 4.8, 5.2, 5.6, 6.0, 6.2, 6.4, 6.5, 7.0, 7.3, 7.6, 7.9, 8.2, 8.4, or 8.6% and independently preferably is not greater than 25, 20, 15, 12, 11, 10, 9.7, 9.4, 9.2, 9.0, 8.9, 8.8, or 8.7%. In a concentrate, the concentration of component (A) preferably is, with increasing preference in the order given, at least 8, 10, 11, 12, 13, or 14%. (The major practical reason for an upper limit for concentration in either concentrates or working compositions is a high viscosity at high concentrations, which may cause handling problems in many plants, For working compositions, a secondary reason for an upper limit for concentration is difficulty in controlling coating weights, particularly in the lower preferred ranges, when the concentration is high.

The molecules of component (A) preferably have a chemical structure that can be produced by condensing ethylene oxide with primary, most preferably straight chain, aliphatic monoalcohols that have, with increasing preference in the order given, at least 25, 30, 35, 40, 43, 46 or 48 carbon atoms per molecule and independently, with increasing preference in the order given, not more than 65, 60, 57, 55, 52, or 51 carbon atoms per molecule. Independently, these actual or hypothetical precursor aliphatic alcohols preferably have no functional groups other than the single —OH moiety, and, optionally but less preferably, also fluoro and/or chloro moieties. Independently, it is preferred that the molecules of ethoxylated alcohols used in a composition according to this invention contain, with increasing preference in the order given, at least 20, 30, 35, 40, 43, 47, or 49%, and independently preferably contain, with increasing preference in the order given, not more than 80, 70, 62, 57, 54, or 51%, of their total mass in the oxyethylene units.

Component (B) is preferably selected from the group consisting of metaboric acid (i.e., $HBO_2$), orthoboric acid ($H_3BO_3$), and alkali metal and ammonium salts of metaboric and orthoboric acids and of the hypothetical tetraboric acid (i.e., $H_2B_4O_7$). More preferably, component (B) is selected from orthoboric acid and salts of tetraboric acid; most preferably a mixture of both orthoboric acid and tetraborate anions is used, and in such a mixture, the molar ratio of orthoboric acid to tetraborate anions preferably is, with increasing preference in the order given, at least 1.0: 1.0, 2.0: 1.0, 3.0: 1.0, 3.5: 1.0, 4.0: 1.0, 4.5:1.0, 5.0:1.0, 5.4:1.0, 5.7:1.0, 5.9:1.0, 6.0:1.0, or 6.1:1.0 and independently preferably is, with increasing preference in the order given, not more than 20:1.0, 15:1.0, 12:1.0, 10:1.0, 9:1.0, 8.0:1.0, 7.5:1.0, 7.0:1.0, 6.7:1.0, 6.4:1.0, or 6.3:1.0. The ratio of the total amount of boron in component (B) to the total of component (A) preferably is, with increasing preference in the order given, not less than 0.002:1.0, 0.005:1.0, 0.007:1.0, 0.009:1.0, 0.011:1.0, 0.013:1.0, 0.015:1.0, 0.017:1.0, 0.019:1.0, 0.021:1.0, or 0.023:1.0, and, if maximum speed of cold working while maintaining normal surface quality standards is desired, more preferably is, with increasing preference in the order given, at least 0.030:1.0, 0.035:1.0, 0.040:1.0, 0.045:1.0, 0.050:1.0, 0.055:1.0, 0.060:1.0, 0.065:1.0, 0.069: 1.0, or 0.071:1.0. Independently, the ratio of the total stoichiometric equivalent as boron in component (B) to the total of the solids content in components (A) preferably is, with increasing preference in the order given, not more than 1.0: 1.0, 0.5:1.0, 0.3:1.0, 0.20:1.0, 0.17:1.0, 0.14:1.0, 0.11:1.0, 0.100:1.0, 0.090:1.0, 0.085:1.0, 0.080:1.0, 0.075:1.0, or 0.073:1.0 and if maximum smoothness of finish on the pointed or drawn surfaces is desired more preferably is, with increasing preference in the order given, not more than 0.062:1.0, 0.050:1.0, 0.040:1.0, 0.030:1.0, or0.025:1.0.

Aqueous compositions containing ethoxylated alcohols sometimes stain or otherwise discolor metal surfaces exposed to them. If this is undesirable, it can generally be prevented by including in the working composition a suitable corrosion inhibitor as an optional component (C). A particularly preferred component (C) comprises, more preferably consists essentially of, or still more preferably consists of:

(C.1) a primary inhibitor component selected from the group consisting of non-sulfur containing organic azole compounds, preferably organic triazoles, more preferably benzotriazole or tolyltriazole; and (C.2) a secondary inhibitor component selected from the group consisting of organic azoles that also contain mercapto moieties, preferably mercaptobenzothiazole or mercaptobenzimidazole.

With this preferred corrosion inhibitor, the concentration of component (C.1) in a working aqueous liquid composition according to this invention preferably is, with increasing preference in the order given, not less than 10, 40, 100, 200, 400, 800, 1200, 1400, 1600, 1800, 2000, 2100, 2200, 2300, 2400, 2450, or 2480 parts per million (hereinafter usually abbreviated "ppm") of the total composition and independently preferably is, with increasing preference in the order given, not more than 20,000, 10,000, 5000, 4000, 3800, 3600, 3300, 3000, 2900, 2800, 2750, 2700, 2675, 2650, 2625, 2600, 2575, 2550, or 2525 ppm. For a concentrate, these concentrations should be increased to correspond to the expected dilution factor when the concentrate is used to make a working composition.

Independently, as already noted above, it is preferred for component (C .1) to be selected from benzotriazole and tolyltriazole, and in fact a mixture of these two is more preferred than either of them alone. The amount of each of benzotriazole and tolyltriazole in a composition according to the invention, expressed as a percentage of the total of component (C.1), preferably is, with increasing preference in the order given, independently for each of these two triazoles, not less than 5, 10, 15, 20, 25, 30, 35, 38, 41, 43, 45, 47, 48, or 49% and independently preferably is, with increasing preference in the order given, not more than 95, 90, 85, 80, 75, 70, 65, 62, 59, 57, 55, 53, 52, or 51%. These ratios, unlike the concentration preferences stated above, apply exactly to concentrates as well as to working compositions.

When present, the concentration of component (C.2) in a working aqueous liquid composition according to this invention preferably is, with increasing preference in the order given, not less than 1, 4, 10, 15, 30, 60, 80, 100, 120, 128, 135, 140, 145, or 149 ppm of the total composition and independently preferably is, with increasing preference in the order given, not more than 2000, 1000, 500, 350, 300, 250, 200, 215, 205, 195, 185, 175, 170, 165, 160, 158, 156, 155, 154, 153, 152, or 151 ppm. The ratio of the concentration of component (C.2) to the concentration of component (C.1) preferably is, with increasing preference in the order given, not less than 0.001:1, 0.002: 1, 0.004:1, 0.007:1, 0.015:1.0, 0.030:1.0, 0.040:1.0, 0.045:1.0, 0.050:1.0, 0.053:1.0, 0.056:1.0, or 0.059:1.0 and independently preferably is, with increasing preference in the order given, not more than 2:1, 1:1, 0.5:1, 0.3:1, 0.2:1, 0.15:1.0, 0.10:1.0, 0.080:1.00, 0.070:1.00, 0.067:1.00, 0.065:1.00, 0.063:1.00, or 0.061:1.00. These ratios, like the preferences for the percentages of the two preferred constituents of component (C.1) stated above, apply exactly to concentrates as well as to working compositions.

The pH of working compositions according to this invention preferably is, with increasing preference in the order given, not less than 3, 4, 5, 6, 7, 7.3, 7.5, 7.7, 7.8, 7.9, or 8.0 and independently preferably is, with increasing preference in the order given, not more than 11, 10, 9.7, 9.4, 9.1, 9.0, 8.9, 8.8, 8.7, 8.6, or 8.5. If necessary to obtain a pH within the preferred range, alkaline or acid materials may be added to the other ingredients of a composition according to the invention as specified above. Normally, addition of alkaline materials to the other ingredients specified above will be needed in order to obtain the most preferred pH values for a working composition according to the invention, and sodium hydroxide is normally preferred as the alkaline material because it is effective and relatively inexpensive. However, other soluble alkali and alkaline earth metal hydroxides, ammonia, mono-, di- and tri-ethanol amines, and dimethyl- and diethyl-ethanol amines are also suitable for raising the pH if needed to bring it into a preferred range.

For various reasons it is often preferred that the compositions according to the invention be free from various materials often used in prior art coating compositions. In particular, compositions according to this invention in most instances preferably contain, with increasing preference in the order given, and with independent preference for each component named, not more than 5, 4, 3, 2, 1, 0.5, 0.25, 0.12, 0.06, 0.03, 0.015, 0.007, 0.003, 0.001, 0.0005, 0.0002, or 0.0001% of each of (i) hydrocarbons, (ii) fatty oils of natural origin, (iii) other ester oils and greases that are liquid at 25° C., (iv) metal salts of fatty acids, (v) hexavalent chromium, (vi) nickel cations, (vii) cobalt cations, (viii) copper cations, (ix) manganese in any ionic form, (x) graphite, (xi) molybdenum sulfide, (xii) copolymers of styrene and maleic moieties, (xiii) oxidized polyethylene, (xiv) urethane polymers and copolymers, (xv) surfactants that are not part of component (A) and are not corrosion inhibitors, (xvi) at least partially neutralized copolymers of (xvi.i) an alkene that contains no carboxyl or carboxylate group and (xvi.ii) a comonomer that is an organic acid including the moiety C=C—COOH; (xvii) polyoxyalkylene polymers not containing an end group having at least 17 carbon atoms in a chain without any intervening carbon-oxygen bonds; and (xviii) alkoxylates of Guerbet alcohols. (For purposes of this description, the term "maleic moiety" is defined as a portion of a polymer chain that conforms to one of the following general chemical formulas:

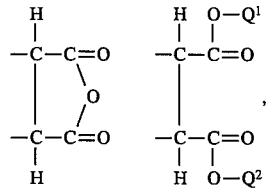

wherein each of $Q^1$ and $Q^2$, which may be the same or different, is selected from the group consisting of hydrogen, alkali metal, ammonium, and substituted ammonium cations.) For possible constituents (xii)–(xviii) as noted above, it is independently preferred that the ratio of the concentration in a composition according to the invention of each of these possible constituents to the concentration of necessary constituent (A) as noted above is, with increasing preference in the order given, not more than 2, 1.5, 1.0, 0.9, 0.8, 0.7, 0.6, 0.5, 0.4, 0.3, 0.2, 0.15, 0.10, 0.07, 0.05, 0.03, 0.02, 0.01, 0.007, 0.005, 0.003, or 0.002.

The specific areal density (also often called "add-on weight [or mass]") of a composition according to this invention, after application from a liquid composition to the metal surface and drying into place on the liquid-coated treated surface of the solid constituents of the liquid coating thus applied, preferably is, with increasing preference in the order given, at least 0.5, 1.0, 1.5, 2.0, 2.5, 3.0, 3.5, 4.0, or 4.5 grams per square meter of surface (hereinafter usually abbreviated as "$g/m^2$"). If maximization of the speed of pointing/drawing and/or minimization of surface roughness on the pointed/drawn tubes is desired, the specific areal density more preferably is at least 5.0 or most preferably at least 5.5. Substantially larger amounts than this may be used without any technical disadvantage, but the specific areal density independently preferably is, with increasing preference in the order given, not more than 100, 80, 75, 70, 65, 60, 55, 50, 45, 40, or 35 $g/m^2$, and if maximum economy is desired more preferably is, with increasing preference in the order given, not more than 30, 25, 20, 15, 10, or 9.0 $g/m^2$.

Generally, in order to speed the drying process and possibly to promote some favorable chemical interaction among the nonvolatile components of a working composition according to this invention, it is preferred to expose the liquid coating formed in a process according to this invention to heat in the course of, or after, drying this liquid coating. The maximum temperature to which the coating is exposed preferably is, with increasing preference in the order given, not less than 30°, 40°, 50°, 60°, or 70° C. and independently preferably is, with increasing preference in the order given, not more than 115°, 110°, 107°, 104°, 102°, or 100° C. Indepedently, the melting point of component (A) in the composition should not be exceeded; for the most preferred examples of component (A), the melting point is about 115° C. The time during which the coating is exposed to the maximum temperature used to dry it preferably is, with increasing preference in the order given, not less than 3, 5, 7, 10, 12, 14, 16, 17, 18, 19, or 20 minutes (hereinafter usually abbreviated "min") and independently preferably is, with increasing preference in the order given, not more than 90, 80, 70, 60, 55, 50, or 45 min.

When a process according to the invention is used for pointing and optionally also drawing tubing, the wall thickness of the tubing preferably is, with increasing preference in the order given, not less than 1, 2, 3, 4, 5, 6, 7, 8, 9, 10, 11, 12, or 13 mm and independently preferably is, with increasing preference in the order given, not more than 50, 30, 25, 22, 19, 18, 17, 16, or 15 min. Independently, the percent area reduction of the tubing in the process, which is defined as $100[(A_b-A_a)/A_b]$, where $A_b$ is the cross-sectional area of the tubing, excluding the area of the hollow space within the tubing, before the process and $A_a$ is the cross-sectional area of the tubing, excluding the area of the hollow space within the tubing, after the process, preferably is, with increasing preference in the order given, at least 20, 23, 26, 29, 32, 35, 37, 39, or 40% and independently preferably is, with increasing preference in the order given, not more than 75, 70, 65, 60, 55, or 50%.

For cold working of steel, a lubricant composition according to this first preferred specific embodiment of this invention preferably is used on clean bare steel without any intermediate coating. However, a lubricant composition according to this first preferred specific embodiment of this invention can also be used over an underlying phosphate conversion coating layer formed on the steel. The phosphate conversion coating may be formed by methods known per se in the art, and iron and manganese phosphate conversion coatings, as well as the zinc based phosphate type conversion coating which is usual as the pretreatment before lubricating with stearate soaps, may be used with this invention. Any phosphate conversion coating used before application of a lubricant composition according to this first preferred specific embodiment of this invention preferably has a specific areal density that is, with increasing preference in the order given, at least 0.2, 0.3, 0.5, 0.7, 1.0, 1.2, 1.4, 1.6, 1.8, or 2.0 g/m$^2$ and independently is, with increasing preference in the order given, not more than 50, 30, 20, 15, 12, or 10 g/m$^2$.

The practice of this invention may be further appreciated by consideration of the following, non-limiting, working examples, and the benefits of the invention may be further appreciated by reference to the comparison examples. (Note: All materials identified below by one of the trademarks BONDERITE®, BONDERLUBE®, PARCO®, PARCOLENE® and REACTOBOND® are commercially available from the Parker Amchem Div. of Henkel Corp., Madison Heights, Mich., together with directions for use as used below, to the extent that the use is not explicitly described below.)

Example and Comparison Example Group 1

In this group, the substrates were cylindrical steel tubes with 76.2 mm outside diameter (hereinafter usually abbreviated "OD") and wall thicknesses of either 14.7 mm or 13.2 mm. All tubes were coated with from 21.5 to 33 g/m$^2$ equivalent dry mass of a composition according to the invention having the ingredients shown in Table 1. This working composition was made by diluting with water a concentrate with a composition shown in Table 2.

The wet composition was dried into place on the exterior and interior of the tubes by heating the coated tubes to about 99° C. for 20 minutes. A total of 10 tubes with the thicker walls and 9 tubes with the thinner walls were coated and then used in the tests described below.

Test 1.1: One end of each of the 19 tubes was pointed by forcing them through first a hard chromed hollow cylindrical steel die with an inside diameter (hereinafter usually abbreviated as "ID") of 66.0 mm and then a hollow cylindrical carbide die with an ID of 55.9 mm. No galling was experienced, and the pointing was fully satisfactory, after increasing the push point grip pressure if needed to avoid slipping of the tubes in these grips. These tubes pointed in this test were then used on their thus-pointed ends for the tests noted below, without the application of additional lubricant.

Test 1.2: The ends of five of the tubes with thinner walls were drawn through a single hollow cylindrical carbide die with an ID of 63.5 mm and around a steel mandrel with an OD of 43.2 mm, the steel mandrel being concentric with the carbide die, to effect a total area reduction of 35.4%. Four of the five had minor but acceptable inside surface roughness but showed no marks on

TABLE 1

COMPOSITION OF THE GROUP I TEST COATING COMPOSITION

| Name of Ingredient | % of Nonvolatile Solids from the Named Ingredient in the Working Test Composition |
|---|---|
| UNITHOX ™ D-300 | 7.2 |
| $H_3BO_3$ | 1.8 |
| $Na_2B_4O_7.10H_2O$ | 0.95 |
| NaOH | 0.27 |
| Benzotriazole | 0.125 |
| Tolyltriazole | 0.125 |
| 2-mercaptobenzimidazole | 0.015 |

Notes for Table 1
UNITHOX ™ D-300 is commercially supplied by the Petrolite Corp., Tulsa, Oklahoma, USA; and is reported by its supplier to be a dispersion in water of a condensation product of aliphatic monohydroxy primary alcohols with an average number of 50 carbon atoms per molecule with an approximately equal mass of ethylene oxide, with a solids content of 23.5 ± 0.5%. The water of hydration in borax is considered to be volatile for calculation of the values in this table. The balance of the composition not shown above was water.

TABLE 2

COMPOSITION OF CONCENTRATE DILUTED TO PRODUCE THE COATING COMPOSITION SHOWN IN TABLE 1.

| Name of Ingredient | % of the Named Ingredient in the Concentrate |
|---|---|
| UNITHOX ™ D-300 | 62.7 |
| $H_3BO_3$ | 3.6 |
| $Na_2B_4O_7.10H_2O$ | 3.6 |
| 50% solution of NaOH in $H_2O$ | 1.09 |
| Benzotriazole | 0.25 |
| Tolyltriazole | 0.25 |
| 2-mercaptobenzimidazole | 0.03 |

Note for Table 2
The balance of the composition not shown above was water.

the outside metal after pointing and drawing; the fifth tube had chatter marks, but it was subsequently determined that its inside surface had not been properly dried.

Test 1.3: The ends of four of the tubes with the thicker walls were drawn through a single hollow cylindrical carbide die with an ID of 57.2 mm (=2.25 in) and around a concentric steel mandrel with an OD of 34.3 mm (=1.35 in), to effect a total area reduction of 37.8 Two of the four tubes showed inside surface pickup and scratches; the remaining two were acceptable but had fine lines on their inside surface.

Test 1.4: The pointed ends of three of the tubes with thicker walls were drawn through the same die as for Test 1.3 but around a concentric steel mandrel with an OD of 31.8 mm (=1.25 in), to effect a total area reduction of 37.7%. Two of the 3 were generally satisfactory but had minor roughness; the remaining one broke "off point", indicating a structural defect in the tubing itself.

Test 1.5: The pointed ends of two of the tubes with thicker walls were drawn through the same die as for Test 1.3 or 1.4 but around a concentric carbide mandrel with an OD of 36.9 mm (=1.451 in), to effect a total area reduction of 47.3%. One was fully satisfactory; one had light interior surface roughness, which is acceptable and normal when using combined zinc phosphate and reactive soap lubrication in this operation, with its high cross sectional reduction.

Test 1.6: The pointed ends of the remaining five tubes with thicker walls were drawn through a hollow cylindrical carbide die with an ID of 63.5 mm (=2.50 in) and around a concentric mandrel with the same size as for Test 1.5. All were fully acceptable and only the last one of the five pointed had any visual defect, specifically minor surface roughness on the interior surface.

The results of Group 1 indicate that the composition according to the invention is highly satisfactory for pointing and also satisfactory for subsequent drawing in an integrated process with pointing.

Comparison Example Group 2

In this group the following alternative lubricant materials, which are representative of chemical types of organic lubricants taught in the prior art, were investigated: NEOPAC™ R9030 urethane-acrylic resin dispersion (hereinafter abbreviated "R9030"), commercially supplied by ICI Resins; CYDROTHANE™ HP6035 urethane resin dispersion (hereinafter abbreviated "HP6035"), commercially supplied by Cytec Industries; ESI-Cryl™ 325N dispersion of oxidized polyethylene in water (hereinafter abbreviated "325N"), commercially supplied by Emulsion Systems Inc., Valley Stream, N.Y.; and SMA2000™ dispersion in water of styrene-maleic anhydride copolymer (hereinafter abbreviated "SMA"), commercially supplied by ATOCHEM, INC., Malvern, Pa. In most cases one or more of these ingredients suggested by the prior art were combined with the same UNITHOX™ D-300 ethoxylated alcohol containing liquid as was used in the compositions according to the invention in Group 1 above; this material is abbreviated "D300" below. The working compositions prepared are shown in Table 3 below.

TABLE 3

INGREDIENTS IN COMPARATIVE WORKING COMPOSITIONS

| Composition | Percent in Composition of Solids from: | | | | | | |
|---|---|---|---|---|---|---|---|
| No. | D300 | R9030 | HP6035 | 325N | SMA | $H_3BO_3$ | Borax[1] |
| 2.1 | 5 | 10 | | | | | |
| 2.2 | 5 | | 10 | | | | |
| 2.3 | | 7.5 | | 7.5 | | | |
| 2.4 | | 20 | | | | | |
| 2.5 | 6 | | | 12 | | 0.8 | 0.4 |
| 2.6 | 10 | 10 | | | | | |
| 2.7[2] | 13.2 | | | | 3.3 | 3.5 | 1.7 |
| 2.8[3] | 13.2 | | | | 3.3 | 3.5 | 1.7 |

Footnotes for Table 3

[1]The water of hydration in borax (i.e., $Na_2B_4O_7.10H_2O$) is considered solid for purposes of this table.

[2]This composition also contained 5.5% of diethylethanolamine (to neutralize the SMA) and 0.4% of ANTARA ™ LB-400 phosphate ester, commercially available from GAF, New York, NY (an extreme pressure lubricant).

[3]This composition also contained the same additional ingredients as Composition 2.7 and also 2.5% of zinc orthophosphate.

Other Notes for Table 3

Blanks indicate that none of the material at the head of the column in which the blank occurs was added to the composition. The balance of each composition not shown in the Table was water.

All the compostions listed in Table 3 were tested in the same general manner as described for Group 1 above, and all were found to produce inferior lubrication for pointing and optional subsequent drawing than was achieved with the compositions in Group 1.

Example and Comparison Example Group 3

The same concentrate as is described in Table 2 above was diluted with water to provide a working composition with 12.5% solids as measured by evaporation of a weighed sample in a microwave oven. This working composition was maintained at 74° C. and used to coat steel tubes as described further below, by immersion of the tubes for a total of 3.5 min in the working composition, with an amount of the working composition containing from 7.5 to 8.6 g/m$^2$ of solids, which was dried onto the tubes at a temperature of 93° C. for 25 min. For comparison, other similar tubes were coated with current high quality conventional zinc phosphate conversion coating (BONDERITE® 18 IX) and reactive lubricant (BONDERLUBE® 234). All tubes, before applying either type of lubricant coating, were conventionally processed by the following steps in succession: (i) Clean by immersion in PARCO® Cleaner 2077X composition for 10 min at 77° C.; (ii) rinse with hot water for 1 min; (iii) pickle in an aqueous solution of 10% by volume of commercial concentrated sulfuric acid; and (iv) neutralize by immersion in an aqueous solution containing 17 g/L of PARCOLENE® 21A neutralizer concentrate at a temperature of 77° C. In all the examples and comparison examples in this group commercial scale processing equipment was used.

Subgroup 3.1

Tubes of ST52 alloy with 168.3 mm OD and 8.9 mm wall thickness were drawn over a mandrel to a finish size of 153.5 mm OD and 7.3 mm wall thickness, which corresponds to a 25% cross sectional area reduction. The tubes coated with a composition according to the invention could be drawn at 25.6 meters per minute (hereinafter usually abbreviated as "m/min") to produce an excellent drawn finish with no OD or ID flaws visually detectable. The comparison tubes with phosphate-soap lubricant could not be satisfactorily drawn at any speed higher than 18.3 m/min under the same conditions because of extreme stick-slip behavior, also called "chatter", at higher speeds.

Subgroup 3.2

Tubes of 1018 alloy with 114 mm OD and 11.8 mm wall thickness were drawn over a mandrel to 97.8 mm OD and 9.3 mm wall thickness, corresponding to a cross-sectional area reduction of 32%. Tubes coated with the composition according to the invention were drawn at speeds up to 24 m/min and had an excellent finish.

Subgroup 3.3

Tubes of T2 alloy with 63.5 mm OD and 6.1 mm wall thickness were drawn on a two speed draw bench to dimensions of 50.8 mm OD and 5.08 mm wall thickness, corresponding to a total area reduction of 33.6%, when coated with the lubricant composition according to the invention, at a speed of 26 m/min with highly satisfactory results. Extensive experience with similar tubes lubricated with the comparison lubricant described above has established that a drawing speed of more than 16 m/min can rarely if ever be achieved without exceeding the electrical load capacity of the same draw bench equipment.

Example and Comparison Example Group 4

In this group, a concentrate with a relatively low boron to ethoxylated alcohol ratio, adjusted to maximize surface finish quality, was used instead of the concentrate described in Table 2 above. The concentrate for this Group had the composition shown in Table 4 below.

To provide a working composition according to the invention for this Group, the concentrate was diluted with water to give a solids content of 7.2% solids. Before application of lubricant, the tubes tested were conventionally cleaned by immersion in PAR-CO® Cleaner 2077X composition for 15 min at 77° C. and then rinsed with warm water for 1 min. Tubes were then immersed for 135 sec in the working lubricant application composition as noted at 71° C. and after removal from this treatment stage were heated for 45 min at 93° C. before drawing, resulting in a specific areal density of 5.4 to 5.9 g/m$^2$ of solid lubricant composition.

Tubes of Stabilus low carbon high manganese and silicon alloy with 20.6 mm OD and 1.1 mm wall thickness and of Ford R1513 alloy with 47.6 mm OD and 2.3 mm wall thickness were prepared as described above and drawn to dimensions of 18 mm OD with 1.0 mm wall thickness, corresponding to 30.3% cross-sectional area reduction, and 41.8 OD with 1.6 mm wall thickness, corresponding to 33.7% cross-sectional area reduction, respectively. Drawing was in a commercial scale plant and was compared to drawing of

TABLE 4

COMPOSITION OF CONCENTRATE USED IN GROUP 4.

| Name of Ingredient | % of the named Ingredient in the Concentrate |
|---|---|
| UNITHOX ™ D-300 | 74.3 |
| $H_3BO_3$ | 1.45 |
| $Na_2B_4O_7.10H_2O$ | 1.45 |
| 50% solution of NaOH in $H_2O$ | 0.33 |
| Benzotriazole | 0.25 |
| Tolyltriazole | 0.25 |
| 2-mercaptobenzimidazole | 0.03 |

Note for Table 4
The balance of the composition not shown above was water.

the same type of tubes lubricated with REACTOBOND® 909 Makeup combination conversion coating and lubricant film, a conventional high quality prior art product for applications when smooth surface finish on the drawn substrate is needed. For both types of lubricant, the surface finish after drawing and other conventional commercial post-drawing treatment was measured with a SURFINDICATOR™ direct reading surface finishing analyzer, which gives either arithmetic average (designated $R_a$) or root mean square (designated $R_t$) surface scratch depths in micrometers for the surfaces tested. Lower values are preferred.

For 14 Stabilus tubes lubricated according to the invention as described above, the $R_t$ values ranged from 1.8 to 5.3 with an average of 2.84 and a standard deviation of 1.33, while the average value of $R_t$ for tubes drawn with the comparison lubricant was significantly higher at 3.75 with a standard deviation of 0.78 over a much larger sample size. The range for these tubes drawn with the comparison lubricant was also rated inferior to those with the lubricant according to the invention.

For the Ford alloy tubes lubricated according to the invention, the mean value of $R_a$ was 0.26 with a standard deviation of 0.11. Any value of $R_a$ less than 0.50 is considered superior, based on the usual results with otherwise identical tubes lubricated with the conventional comparison lubricant noted above.

The invention claimed is:

1. A liquid composition suitable for applying to metal substrates a lubricating layer for cold working after drying on the metal substrates, said liquid composition consisting essentially of water and the following dissolved, dispersed, or both dissolved and dispersed components:

(A) ethoxylated straight chain aliphatic alcohol molecules, wherein the initial alcohol molecules have a single —OH moiety and at least 25 carbon atoms; and (B) a component of inorganic boron containing acids or salts thereof, wherein in said liquid composition the ratio of the amount of each of: copolymers of styrene and maleic moieties; oxidized polyethylene: urethane polymers and copolymers; at least partially neutralized copolymers of (i) an alkene that contains no carboxyl or carboxylate group and (ii) a comonomer that is an organic acid including the moiety C=C—COOH; surfactants that are not part of component (A) and are not corrosion inhibitors; polyoxyalkylene polymers not containing an end group having at least 17 carbon atoms in a chain without any intervening carbon-oxygen bonds; and alkoxylates of Guerbet alcohols; these being individually or collectively denoted hereinafter as "disfavored organic component(s)", to the amount of component (A) is not greater than 0.5.

2. A liquid composition according to claim 1, wherein: component (A) is selected from the group consisting of ethoxylated alcohol molecules in which the initial alcohols have from about 25 to about 65 carbon atoms; the concentration of component (A) is from about 1.6 to about 20% of the total composition; component (B) is selected from the group consisting of metaboric acid, orthoboric acid, and the alkali metal and ammonium salts of metaboric and orthoboric acids and of the hypothetical tetraboric acid; and the ratio of the total amount of boron in component (B) to the total of the solids content of component (A) is from about 0.009:1.0 to about 0.5:1.0.

3. A liquid composition according to claim 2, wherein: component (A) is selected from the group consisting of ethoxylated alcohol molecules in which the initial alcohols have from about 30 to about 65 carbon atoms; component (B) includes both orthoboric acid and tetraborate anions in a molar ratio from about 1.0:1.0 to about 20: 1.0; and the ratio of the total amount of boron in component (B) to the total of component (A) is from about 0.015:1.0 to about 0.20:1.0.

4. A concentrate composition according to claim 3, wherein the concentration of component (A) is at least about 10%.

5. A working composition according to claim 3, wherein the concentration of component (A) is from about 3.2 to about 20% of the total composition and the composition also includes from about 800 to about 20,000 ppm of a primary corrosion inhibitor component (C.1) selected from the group consisting of non-sulfur-containing organic azole compounds and from about 30 to about 2000 ppm of a secondary corrosion inhibitor component (C.2) selected from the group consisting of organic azoles that also contain mercapto moieties, the ratio of the concentration in the composition of component (C.2) to component (C.1) being from about 0.030:1.0 to about 0.10:1.0.

6. A liquid composition according to claim 3, wherein: component (A) is selected from the group consisting of ethoxylated alcohol molecules in which the initial alcohols have from about 40 to about 60 carbon atoms; component (B) includes both orthoboric acid and tetraborate anions in a molar ratio from about 3.5:1.0 to about 9:1.0; and the ratio of the total amount of boron in component (B) to the total of component (A) is from about 0.017:1.0 to about 0.11:1.0; the composition also includes from about 1800 to about 3800 ppm of a primary corrosion inhibitor component (C.1) selected from the group consisting of non-sulfur-containing organic azole compounds, with at least 30% of component (C.1) consisting of each of benzotriazole and tolyltriazole, and from about 30 to about 1000 ppm of a secondary corrosion inhibitor component (C.2) selected from the group consisting of mercaptobenzothiazole and mercaptobenzimidazole.

7. A concentrate composition according to claim 6, wherein the concentration of component (A) is at least about 12%.

8. A working composition according to claim 6, wherein the concentration of component (A) is from about 4.8 to about 12% of the total composition and; the composition also includes from about 1800 to about 3800 ppm of a primary corrosion inhibitor component (C.1) selected from the group consisting of non-sulfur-containing organic azole compounds, with at least 30% of component (C.1) consisting of each of benzotriazole and tolyltriazole, and from about 30 to about 1000 ppm of a secondary corrosion inhibitor component (C.2) selected from the group consisting of mercaptobenzothiazole and mercaptobenzimidazole.

9. A liquid composition according to claim 4, wherein: component (A) is selected from the group consisting of ethoxylated alcohol molecules in which the initial alcohols have from about 43 to about 57 carbon atoms; component (B) includes both orthoboric acid and tetraborate anions in a molar ratio from about 4.0:1.0 to about 8.0: 1.0; the ratio of the total amount of boron in component (B) to the total of the solids content of component (A) is from about 0.021:1.0 to about 0.075:1.0.

10. A concentrate composition according to claim 9, wherein the concentration of component (A) is at least 14%.

11. A working composition according to claim 9, wherein the concentration of component (A) is from about 6.5 to about 12.0% of the total composition and the composition also includes from about 2100 to about 2900 ppm of a primary corrosion inhibitor component (C.1) selected from the group consisting of non-sulfur-containing organic azole compounds, with at least 35% of component (C.1) consisting of each of benzotriazole and tolyltriazole, and from about 120 to about 170 ppm of a secondary corrosion inhibitor component (C.2) selected from the group consisting of mercaptobenzothiazole and mercaptobenzimidazole, the ratio of the concentration in the composition of component (C.2) to component (C.1) being from about 0.040:1.0 to about 0.080: 1.0.

12. A working composition according to claim 11, wherein: component (A) is selected from the group consisting of ethoxylated alcohol molecules in which the initial alcohols have from about 46 to about 52 carbon atoms and in which from about 43 to about 57% of the total mass of the molecules is in their oxyethylene units; component (B) includes both orthoboric acid and tetraborate anions in a molar ratio from about 6.0:1.0 to about 6.4:1.0; the ratio of the total amount of boron in component (B) to the total of the solids content of component (A) is from about 0.021:1.0 to about 0.030: 1.0; the composition also includes from about 2400 to about 2600 ppm of a primary corrosion inhibitor component (C.1) selected from the group consisting of non-sulfur-containing organic azole compounds, with each of benzotriazole and tolyltriazole constituting at least about 45% of component (C.1), and from about 140 to about 160 ppm of a secondary corrosion inhibitor component (C.2) selected from the group consisting of mercaptobenzothiazole and mercaptobenzimidazole, the ratio of the concentration in the composition of component (C.2) to component (C.1) being from about 0.053:1.0 to about 0.063:1.0; and the ratio of the total amount of the disfavored organic components to the amount of component (A) in the composition is not greater than 0.1.

13. A working composition according to claim 11, wherein: component (A) is selected from the group consisting of ethoxylated alcohol molecules in which the initial alcohols have from about 46 to about 52 carbon atoms and in which from about 43 to about 57% of the total mass of the molecules is in their oxyethylene units; component (B) includes both orthoboric acid and tetraborate anions in a molar ratio from about 6.0:1.0 to about 6.4: 1.0; the ratio of the total amount of boron in component (B) to the total of the solids content of component (A) is from about 0.069:1.0 to about 0.075:1.0; the composition also includes from about 2400 to about 2600 ppm of a primary corrosion inhibitor component (C.1) selected from the group consisting of non-sulfur-containing organic azole compounds, with each of benzotriazole and tolyltriazole constituting at least about 45% of component (C.1), and from about 140 to about 160 ppm of a secondary corrosion inhibitor component (C.2) selected from the group consisting of mercaptobenzothiazole and mercaptobenzimidazole, the ratio of the concentration in the composition of component (C.2) to component (C.1) being from about 0.053:1.0 to about 0.063:1.0; and the ratio of the total amount of the disfavored organic components to the amount of component (A) in the composition is not greater than 0.1.

14. A process of providing metal tubing with a solid lubricant layer suitable for subsequent pointing, drawing, or both pointing and drawing of the tubing, said process comprising steps of:

(I) coating the surface of the tubing with a liquid layer of a composition according to claim 13 having a pH from about 8.0 to about 8.5, said liquid layer having a solids content of from about 5.5 to about 35 $g/m^2$ of the surface coated; and (II) drying into place on the surface of the tubing the solids content of the liquid layer formed in step (I) by exposure of the tubing coated with the liquid layer to a temperature in the range from about 70° to about 100° C. for a time from about 20 to about 45 minutes.

15. A process of providing metal tubing with a solid lubricant layer suitable for subsequent pointing, drawing, or both pointing and drawing of the tubing, said process comprising steps of:

(I) coating the surface of the tubing with a liquid layer of a composition according to claim 12 having a pH from about 8.0 to about 8.5, said liquid layer having a solids content of from about 5.5 to about 9.0 g/m$^2$ of the surface coated; and (II) drying into place on the surface of the tubing the solids content of the liquid layer formed in step (I) by exposure of the tubing coated with the liquid layer to a temperature in the range from about 70° to about 100° C. for a time from about 20 to about 45 minutes.

16. A process of providing metal tubing with a solid lubricant layer suitable for subsequent pointing, drawing, or both pointing and drawing of the tubing, said process comprising steps of:

(I) coating the surface of the tubing with a liquid layer of an aqueous working composition consisting of a composition according to claim 11 having a pH from about 7.5 to about 9.0, the amount of said liquid layer having a solids content of from about 2. to about 35 g/m$^2$ of the surface coated; and (II) drying into place on the surface of the tubing the solids content of the liquid layer formed in step (I) by exposure of the tubing coated with the liquid layer to a temperature in the range from about 60° to about 104° C. for a time from about 16 to about 50 minutes.

17. A process of providing metal tubing with a solid lubricant layer suitable for subsequent pointing, drawing, or both pointing and drawing of the tubing, said process comprising steps of:

(I) coating the surface of the tubing with a liquid layer of an aqueous working composition according to claim 8 having a pH from about 7 to about 9.4, the amount of said liquid layer having a solids content of from about 2 to about 35 g/m$^2$ of the surface coated; and (II) drying into place on the surface of the tubing the solids content of the liquid layer formed in step (I) by exposure of the tubing coated with the liquid layer to a temperature in the range from about 50° to about 110° C. for a time from about 10 to about 60 minutes.

18. A process of providing metal tubing with a solid lubricant layer suitable for subsequent pointing, drawing, or both pointing and drawing of the tubing, said process comprising steps of:

(I) coating the surface of the tubing with a liquid layer of an aqueous working composition according to claim 5 having a pH from about 6 to about 9.7, the amount of said liquid layer having a solids content of from about 2 to about 50 g/m$^2$ of the surface coated; and (II) drying into place on the surface of the tubing the solids content of the liquid layer formed in step (I) by exposure of the tubing coated with the liquid layer to a temperature in the range from about 40° to about 110° C. for a time from about 7 to about 60 minutes.

19. A process of providing metal tubing with a solid lubricant layer suitable for subsequent pointing, drawing, or both pointing and drawing of the tubing, said process comprising steps of:

(I) coating the surface of the tubing with a liquid layer of an aqueous working composition consisting of at least about 25% of a composition according to claim 1, and, optionally, either or both of a pH adjustment agent and water, said aqueous working composition having a pH from about 5 to about 10, the amount of said liquid layer having a solids content of from about 4.5 to about 50 g/m$^2$ of the surface coated; and (II) drying into place on the surface of the tubing the solids content of the liquid layer formed in step (I) by exposure of the tubing coated with the liquid layer to a temperature in the range from about 30° to about 110° C. for a time from about 3 to about 90 minutes.

20. A process of providing metal tubing with a solid lubricant layer suitable for subsequent pointing, drawing, or both pointing and drawing of the tubing, said process comprising steps of:

(I) coating the surface of the tubing with a liquid layer of an aqueous working composition comprising at least about 4.0% of molecules selected from the group consisting of ethoxylated straight chain aliphatic alcohol molecules, wherein the initial alcohol molecules have a single —OH moiety and at least 18 carbon atoms, said aqueous working composition comprising not more than 0.4% in total of the following: copolymers of styrene and maleic moieties; oxidized polyethylene; urethane polymers and copolymers; at least partially neutralized copolymers of (i) an alkene that contains no carboxyl or carboxylate group and (ii) a comonomer that is an organic acid including the moiety C=C—COOH; surfactants that are not ethoxylated straight chain aliphatic alcohol molecules, wherein the initial alcohol molecules have a single —OH moiety and at least 18 carbon atoms, and are not corrosion inhibitors; polyoxyalkylene polymers not containing an end group having at least 17 carbon atoms in a chain without any intervening carbon-oxygen bonds; and alkoxylates of Guerbet alcohols; said aqueous working composition having a pH from about 7.7 to about 9.4, the amount of said liquid layer having a solids content of from about 1.0 to about 100 g/m$^2$ of the surface coated; and (II) drying into place on the surface of the tubing the solids content of the liquid layer formed in step (I).

* * * * *